US007330156B2

(12) United States Patent
Arkko et al.

(10) Patent No.: US 7,330,156 B2
(45) Date of Patent: Feb. 12, 2008

(54) ANTENNA ISOLATION USING GROUNDED MICROWAVE ELEMENTS

(75) Inventors: Aimo Arkko, Ruutana (FI); Jani Ollikainen, Helsinki (FI); Shunya Sato, Tokyo (JP); Hawk Yin Pang, Tokyo (JP)

(73) Assignee: Nokia Corporation

( * ) Notice: Subject to any disclaimer, the term of this patent is extended or adjusted under 35 U.S.C. 154(b) by 5 days.

(21) Appl. No.: 11/179,811

(22) Filed: Jul. 11, 2005

(65) Prior Publication Data

US 2006/0044195 A1 Mar. 2, 2006

Related U.S. Application Data

(60) Provisional application No. 60/603,459, filed on Aug. 20, 2004.

(51) Int. Cl.
*H01Q 1/24* (2006.01)

(52) U.S. Cl. ..... 343/702; 343/700 MS

(58) Field of Classification Search ..... 343/702, 343/700 MS, 84.6, 846, 848, 841
See application file for complete search history.

(56) References Cited

U.S. PATENT DOCUMENTS 4,460,899 A * 7/1984 Schmidt et al. ..... 343/841
6,259,407 B1 7/2001 Tran
6,560,443 B1 * 5/2003 Vaisanen et al. ..... 455/73
6,765,536 B2 * 7/2004 Phillips et al. ..... 343/702
6,985,114 B2 * 1/2006 Egashira ..... 343/702
7,030,830 B2 * 4/2006 Azoulay et al. ..... 343/815
7,095,371 B2 * 8/2006 Monebhurrun et al. ..... 343/700 MS
2002/0180651 A1 12/2002 Hareyama et al.
2003/0132883 A1 7/2003 Wong et al.
2004/0036655 A1 2/2004 Sainati et al.
2004/0051669 A1 * 3/2004 Rutfors et al. ..... 343/702
2005/0110692 A1 * 5/2005 Andersson ..... 343/702

OTHER PUBLICATIONS

Antennas for All Applications, by John D. Kraus and Ronald J. Marhefka, McGraw-Hill, 3d Edition, 2002, Chapter 23, Baluns, etc. p. 803-826.

* cited by examiner

*Primary Examiner*—Hoanganh Le

(57) ABSTRACT

This invention describes a method for improving antenna isolation in an electronic communication device using grounded RF microwave elements and patterns (structures). According to embodiments of the present invention, the RF microwave element can be implemented as a short-circuited section of a quarter-wavelength long transmission line (such as a stripline), or the RF microwave element can contain a metallic coupler and two thin striplines with different lengths, or the RF microwave element can be implemented using a balun concept.

27 Claims, 18 Drawing Sheets

ANTENNA ISOLATION USING GROUNDED MICROWAVE ELEMENTS

CROSS REFERENCE TO RELATED APPLICATION

This application claims priority from U.S. Provisional Patent Application Ser. No. 60/603,459 filed Aug. 20, 2004.

TECHNICAL FIELD

This invention generally relates to antennas and more specifically to improving an antenna isolation in handsets or wireless communication devices.

BACKGROUND ART

Mutual coupling means the electromagnetic interaction of nearby antenna elements in a multi-antenna system. The currents in each element couple electromagnetically to the neighboring elements thus distorting the ideal current distributions along the elements. This causes changes in the radiation patterns and also in the input impedances of the antennas. From the RF point of view, isolation between the feeding ports of the antennas and mutual coupling are the same thing. So low isolation means high coupling causing energy transfer between the ports and, therefore, decrease in the efficiencies of the antennas. The strength of the isolation can be measured by looking at the scattering (S-) parameters of the antennas. So, for example, the S-parameter $S_{21}$ determines how much energy is leaking from port 1 to port 2.

Furthermore, a typical mobile phone antenna is generally compounded of a resonating antenna element and a more or less resonating chassis of the phone, working as a positive pole and a negative pole of the antenna, respectively. This generalization is valid regardless of the type of the antenna element. In practice, the ground plane of the PWB (printed wiring board) also works as the main ground for the antenna and, depending on the inner structure of the phone, the currents induced by the antenna extend over the whole chassis. On the PWB the currents are concentrated on the edges.

Modern phone terminals are designed to operate in several cellular and also non-cellular systems. Therefore, the terminals must also include several antenna elements in order to cover all the desired frequency bands. In some cases even two antennas working at the same frequency band are required for optimizing the performance. In small terminals the antenna elements are located very close to each other thus leading to a low natural isolation. This problem arises especially at low frequencies, where the electrical size of the terminal is small, and when the coupled antennas work at the same frequency band. Moreover, the antennas are also connected galvanically via the PWB acting as a mutual ground plane for the antennas.

Furthermore, the performance of a mobile phone antenna depends strongly on a size of the PWB. Optimal performance is achieved when the size coincides with certain resonance dimensions, i.e., when the width and the length of the PWB are suitably chosen compared with wavelength. Therefore, an optimal size for the PWB depends on the frequency. A non-resonating ground plane causes significant reduction in the impedance bandwidth and in the efficiency of the antenna. On the other hand, the currents on a resonating ground plane are strong causing significant electromagnetic coupling between the antenna and the other RF-parts of the phone. Furthermore, the strong chassis currents also define the locations of the SAR (specific absorption rate) maximums.

Furthermore, mobile phones have been designed mainly in a mono block form but demands from customers for a variety of forms are increasing. Fold phones are extremely popular already in Asia and they are getting popular year by year in Europe and America. Slide phones have also joined the competition. From antenna design point of view, moving from the mono block form to the fold or slide form adds extra complexity and difficulties for achieving an adequate performance at all possible modes of operation of a fold/slide device.

Because small antenna on mobile phones is heavily relying on its chassis dimension to work as an important part of the antenna length, an antenna performance changes dramatically when the fold/slide phone changes its modes from open to close. That makes the antenna design very difficult and forces a designer either to optimize the design for one mode while sacrificing for another or compromise at both modes to find a good balance. Inserting series inductors at the connection of lower and upper parts of the phone is one known prior art solution to the problem. It isolates lower and upper parts from an RF point of view. But it requires a large area on the PWB to accommodate numbers of inductors for each line connecting upper and lower halves. Insulating a metallic hinge also remains problematic.

DISCLOSURE OF THE INVENTION

The object of the present invention is to provide a method for improving antenna isolation in an electronic communication device (e.g. a mobile phone or a handset) using ground RF microwave elements and patterns (structures) such as strip lines or using a balun concept.

According to a first aspect of the invention, an electronic communication device comprises: at least one antenna; and an RF microwave element in a ground plane of the at least one antenna for providing an isolation from electro-magnetically coupled currents between the at least one antenna and other RF components of the electronic communication device in the ground plane.

According further to the first aspect of the invention, the electronic communication device may be a portable communication device, a mobile electronic device, a mobile phone, a terminal or a handset.

Further according to the first aspect of the invention, the other RF components may include at least one further antenna. Further, the electronic communication device may contain more than one of the at least one further antenna. Still further, the at least one further antenna may be a whip-type antenna.

Still further according to the first aspect of the invention, the at least one antenna may be a planar inverted-F antenna.

According further to the first aspect of the invention, the RF microwave element may be a short-circuited section of a quarter-wavelength long transmission line. Further, the quarter-wavelength long transmission line may be a stripline.

According still further to the first aspect of the invention, the RF microwave element may contain a metallic coupler and two striplines. Further, the two striplines may have different lengths.

According further still to the first aspect of the invention, the electronic communication device may have at least two blocks which can fold or slide relative to each other to facilitate different modes of operation of the electronic communication device. Further, the RF microwave element may be a balun structure attached to at least one of the at least two blocks. Still further, the balun structure may be implemented as a rod made of a conducting material parallel to the at least one of the at least two blocks and attached to the at least one of the at least two blocks at one end of the rod, wherein another end of the rod is left open and the rod has a length of substantially a quarter wavelength which the electronic communication device operates on.

According to a second aspect of the invention, a method for isolating from electro-magnetically coupled currents in a ground plane between at least one antenna and other RF elements in an electronic communication device, comprises the step of: placing an RF microwave element in a ground plane of the at least one antenna for providing an isolation from electro-magnetically coupled currents between the at least one antenna and other RF elements of the electronic communication device in the ground plane.

According further to the second aspect of the invention, the electronic communication device may be a portable communication device, a mobile electronic device, a mobile phone, a terminal or a handset.

Further according to the second aspect of the invention, the other RF components may include at least one further antenna. Further, the electronic communication device may contain more than one of the at least one further antenna. Still further, the at least one further antenna may be a whip-type antenna.

Still further according to the second aspect of the invention, the at least one antenna may be a planar inverted-F antenna.

According further to the second aspect of the invention, the RF microwave element may be a short-circuited section of a quarter-wavelength long transmission line. Further, the quarter-wavelength long transmission line may be a stripline.

According still further to the second aspect of the invention, the RF microwave element may contain a metallic coupler and two striplines. Further, the two striplines may have different lengths.

According further still to the second aspect of the invention, the electronic communication device may have at least two blocks which can fold or slide relative to each other to facilitate different modes of operation of the electronic communication device. Further, the RF microwave element may be a balun structure attached to at least one of the at least two blocks. Still further, the balun structure may be implemented as a rod made of a conducting material parallel to the at least one of the at least two blocks and attached to the at least one of the at least two blocks at one end of the rod, wherein another end of the rod is left open and the rod has a length of substantially a quarter wavelength which the electronic communication device operates on.

By using this kind of ground RF elements it is possible to achieve considerable natural isolation between antenna elements placed on a mobile terminal and, by this way, to get more freedom in positioning the antenna elements. It is also possible to design isolated diversity antenna structures for the low band. Generally this method helps also in controlling the currents flowing along the PWB, thus giving a better control also on the coupling to other RF parts of the terminal and on the SAR (specific absorption rate).

Furthermore, another main advantage in using this kind of ground RF structures is to achieve a better control on the ground plane currents. As a consequence, it is easier to isolate the antenna from other RF-parts. Secondly, it is possible to optimize the grounding for multi-band operation. It is also possible to adjust the locations of the local SAR maximums by the design of the ground striplines. Moreover, this idea could be exploited in designing general antenna solutions, i.e. antennas that can be implemented directly in several phone concepts.

Furthermore, balun structure in phones for preventing an unwanted current flow can solve the problem of antenna performance degradation due to the change of modes of operation of a portable radio device. The invention applies to the compact structures which can be implemented in small phones while prior art (inserting series inductors) would take a large area on the PWB which is not acceptable for designing small phones.

Also the prior art cannot solve metallic hinge connection but this invention solves this problem regardless of the connection. Moreover, the prior solution of inserting series inductors may cause an ESD (electrostatic discharge) problem and EMC designers are reluctant to implement it (the inductors will cause a voltage difference in flip and grip modes). But this is not a problem with the present invention.

BRIEF DESCRIPTION OF THE DRAWINGS

For a better understanding of the nature and objects of the present invention, reference is made to the following detailed description taken in conjunction with the following drawings, in which:

FIG. 4*b* is a close look of the middle portion of FIG. 4*a;*

BEST MODE FOR CARRYING OUT THE INVENTION

The present invention provides a new method for improving antenna isolation in an electronic communication device using grounded RF microwave elements and patterns (structures). According to embodiments of the present invention, the RF microwave element can be implemented as a short-circuited section of a quarter-wavelength long transmission line (such as a stripline), or the RF microwave element can contain a metallic coupler and two thin striplines with different lengths, or said the RF microwave element can be implemented using a balun concept. The electronic communication device can be a portable communication device, a mobile electronic device, a mobile phone, a terminal, a handset, etc.

According to an embodiment of the present invention, in a small terminal, it is possible to increase the isolation between two antennas significantly by suppressing the currents flowing along certain parts of the ground plane with a device that provides a high impedance (i.e., an impedance wall) or an impedance discontinuity at an appropriate location (acting like an isolator). This kind of impedance discontinuity can be achieved, e.g., with a short-circuited section of a $\lambda/4$ (quarter wavelength)-long transmission line (microstrip, stripline), which provides a high impedance at an open end, thus preventing the flow of the ground plane currents in that direction. It is possible to implement structures where, firstly, an antenna element operates both as an isolator and as a radiator or, secondly, some other RF-parts of the terminal (e.g., a display frame) can work as an isolator.

Figure 1A:
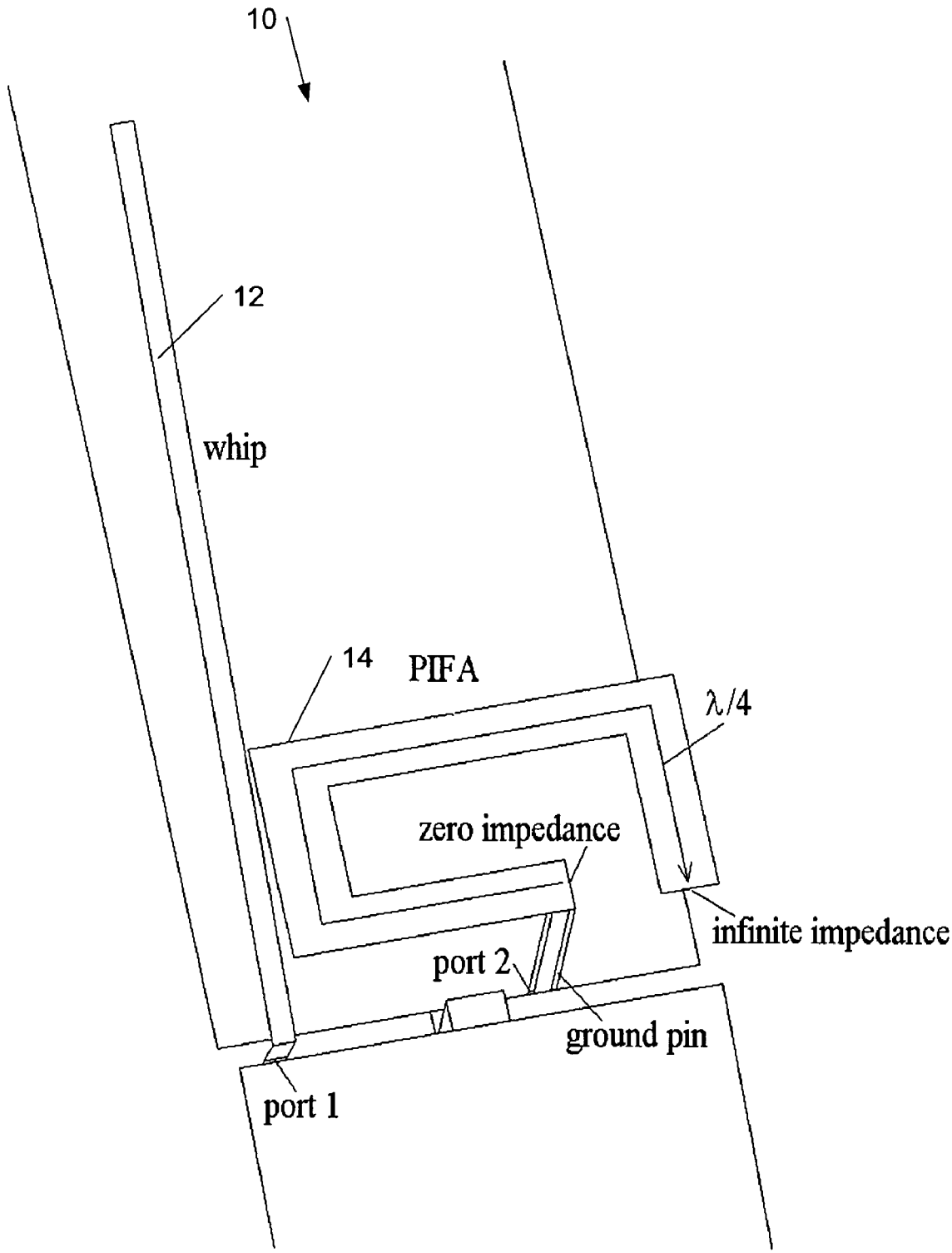
FIG. 1*a* is a schematic representation of an antenna structure wherein a PIFA-type antenna causes an impedance discontinuity for ground plane currents induced by a whip antenna.
Figure 1B:
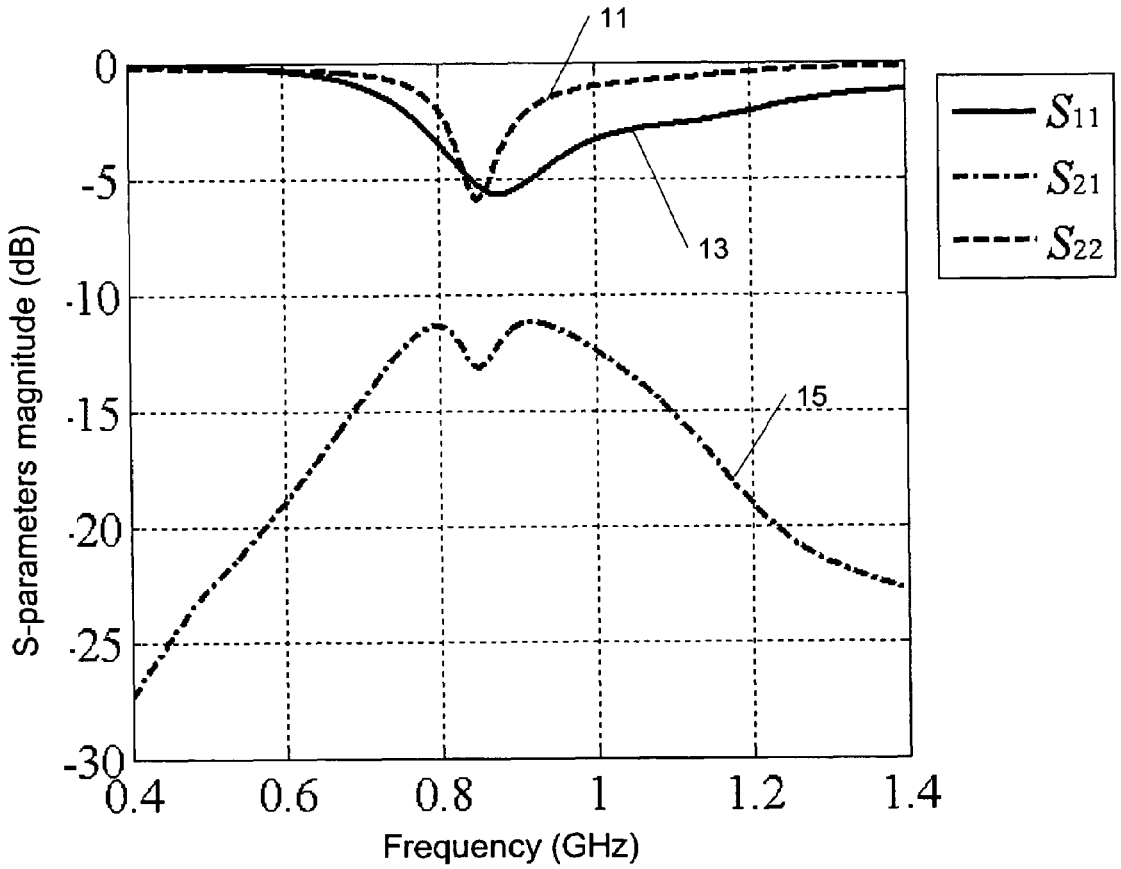
FIG. 1*b* is a graph of simulated S-parameters in a free space as a function of frequency for the structure of FIG. 1*a*, wherein an impedance discontinuity causes a local isolation maximum around 850 MHz.

FIG. 1*a* shows one example among others of a schematic representation of an antenna structure 10 wherein a planar inverted-F antenna (PIFA) 14 (alternatively can be called a PIFA-type antenna 14) causes an impedance discontinuity for the ground plane currents induced by a whip-type (whip) antenna 12, and FIG. 1*b* shows a graph of simulated S-parameters in a free space as a function of frequency for the structure of FIG. 1*a*, wherein the impedance discontinuity causes a local isolation maximum around 850 MHz.

In the configuration shown in FIG. 1*a*, the whip antenna 12 and the PIFA (or the PIFA-type antenna) 14 are placed on a flip-type terminal. Both antennas work at 850 MHz band. As can be seen in the simulated S-parameter results (curves 11, 13 and 15 corresponds to $S_{22}$, $S_{11}$ and $S_{21}$ parameters, respectively) shown in FIG. 1*b*, there exists a local isolation maximum over the desired 850 MHz band for all three curves 11, 13 and 15. This isolation maximum can be improved and also be fairly easily tuned to a different band by adjusting the length of the PIFA 14 and the location of the PIFA ground pin. This local isolation maximum is caused by the impedance discontinuity along the upper chassis part, due to the PIFA 14 itself. Depending on locations of the ground pin and the open end of the PIFA 14, the currents are flowing along the ground planes in such a way, that the electromagnetic coupling between the two antennas 12 and 14 decreases at the resonance frequency. If the PIFA 14 was removed, the ground plane currents induced by the whip antenna 12 would flow also freely on the upper chassis part. On the other hand, it is generally known that RF currents along a wide metal plate are concentrated on the edges. Therefore, the PIFA 14 is now seen to the whip antenna 12 as a short-circuited section of a $\lambda/4$-long transmission line, providing an impedance wall at the open end, thus preventing the flow of the ground plane currents induced by the whip antenna 12 in that direction.

Figure 2A:
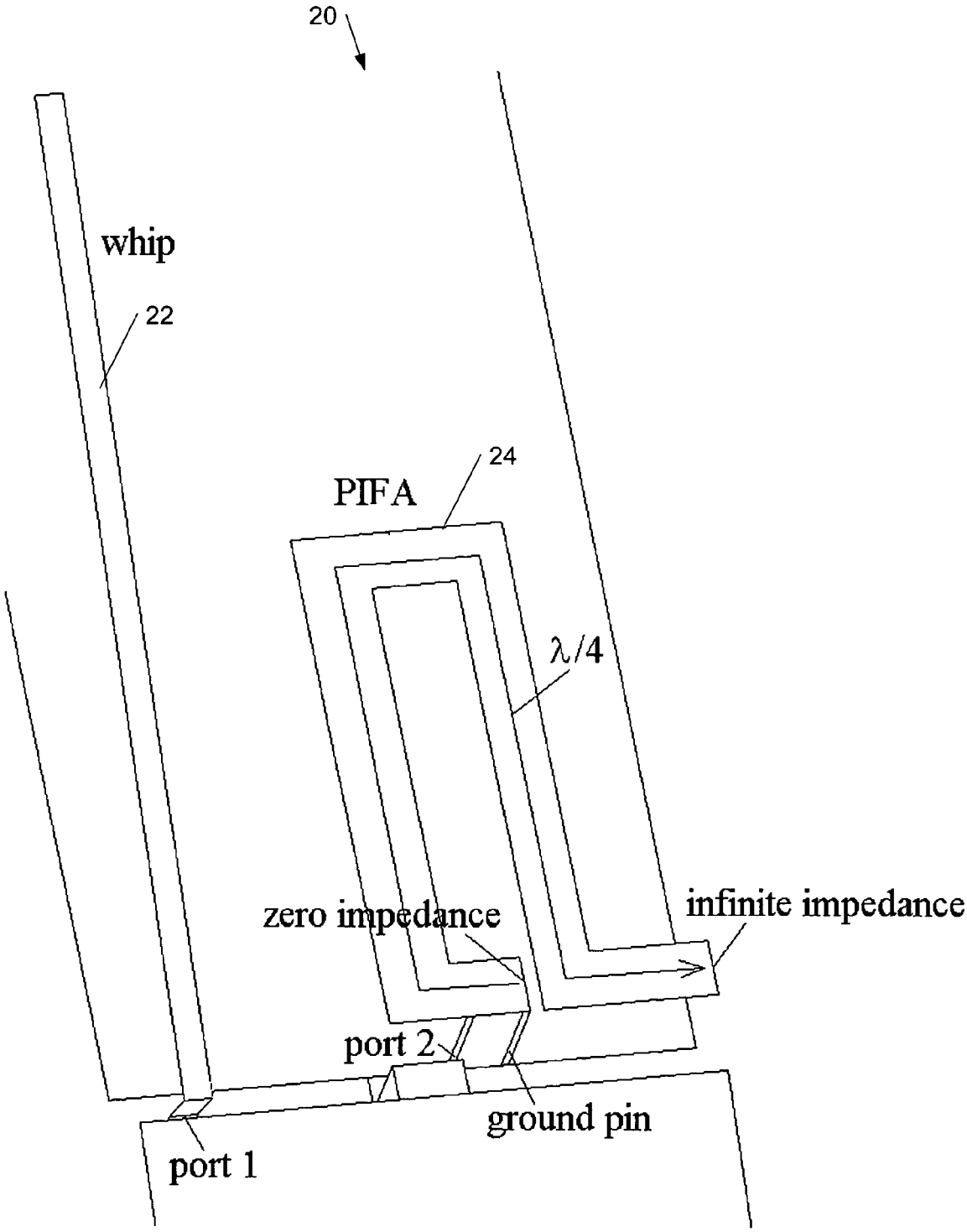
FIG. 2*a* is a schematic representation of another antenna structure wherein a PIFA-type antenna causes an impedance discontinuity for ground plane currents induced by a whip antenna.
Figure 2B:
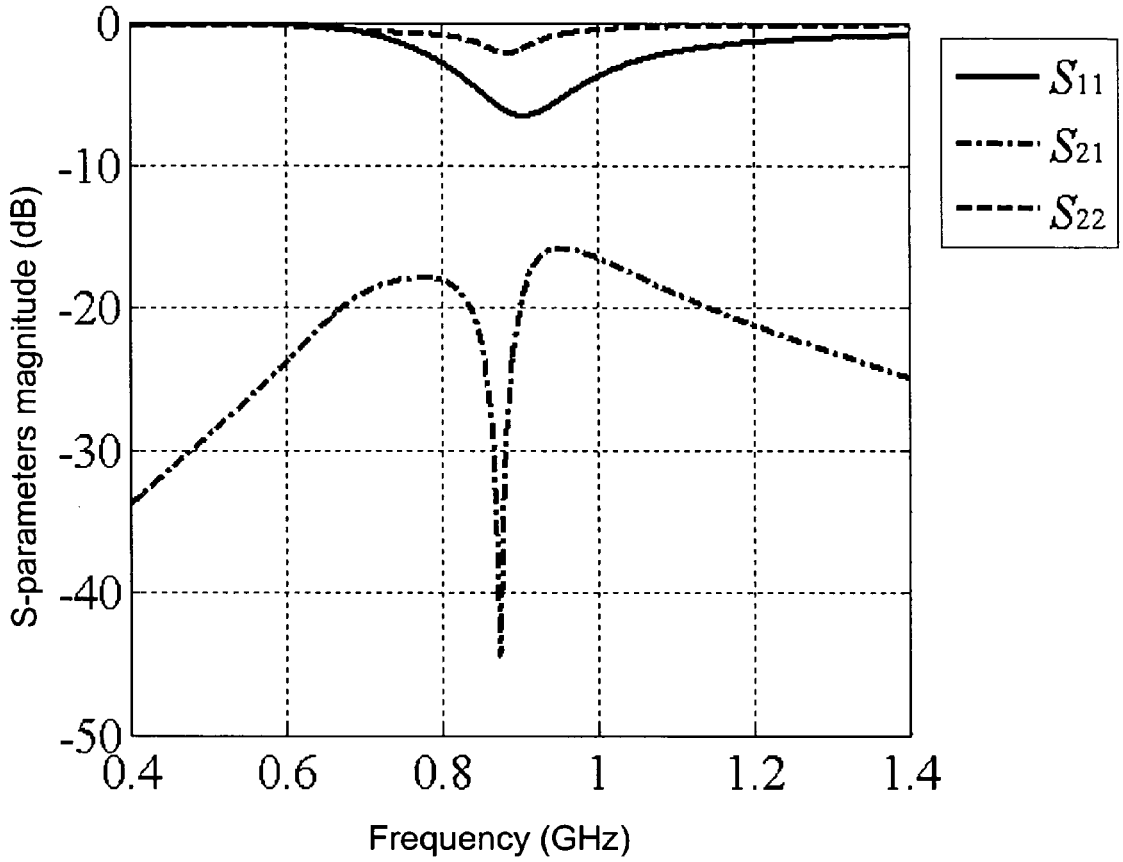
FIG. 2*b* is a graph of simulated S-parameters in a free space as a function of frequency for the structure of FIG. 2*a*, wherein an impedance discontinuity causes a local isolation maximum around 850 MHz; though the impedance discontinuity causes a clear local isolation maximum but at the same time the suppressed currents along the ground plane dismatch both antennas.
Figure 2C:
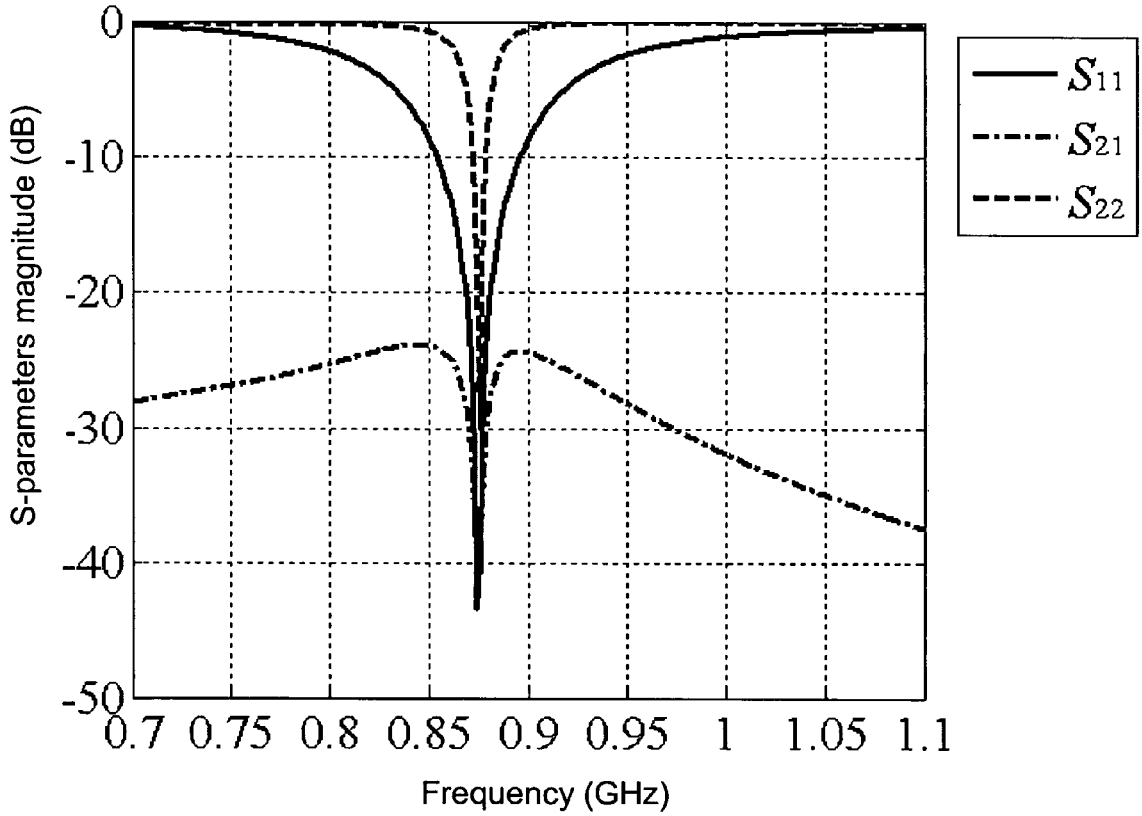
FIG. 2*c* is a graph of simulated S-parameters in a free space as a function of frequency for the structure of FIG. 2*a* with lumped matching circuits at antenna feeds.

FIGS. 2*a*-2*c* show another example among others of the same concepts described in regard to FIGS. 1*a* and 1*b*.

FIG. 2*a* is a schematic representation of another antenna structure 20 wherein a PIFA-type antenna 24 again causes an impedance discontinuity for the ground plane currents induced by a whip antenna 22. FIG. 2*b* is a graph of simulated S-parameters in a free space as a function of frequency for the structure of FIG. 2*a*, wherein the impedance discontinuity causes a local isolation maximum around 850 MHz; though the impedance discontinuity causes a clear local isolation maximum but at the same time the suppressed currents along the ground plane dismatch both antennas. The problem of dismatching can be solved by using lumped matching circuits at both antenna 22 and 24 feeds (the lumped matching circuits are not shown in FIG. 2*a*). Both circuits include series-L and parallel-C elements: for feed 1 (whip antenna 12) L=5.44 nH and C=5.22 pF and for feed 2 (PIFA 24) L=14.34 nH and C=6.22 pF. FIG. 2*c* is a graph of simulated S-parameters in a free space as a function of frequency for the structure of FIG. 2*a* with lumped matching circuits at antenna feeds. As shown in FIG. 2*c*, the isolation is very sharp and significantly improved compared to the case without matching circuits as shown in FIG. 2*b*.

According to an embodiment of the present invention, FIGS. 3*a*-3*b* and 4*a*-4*d* show more examples among others for the concept of the antenna isolation but using a separate stripline-configuration for directing the ground plane currents.

Figure 3A:
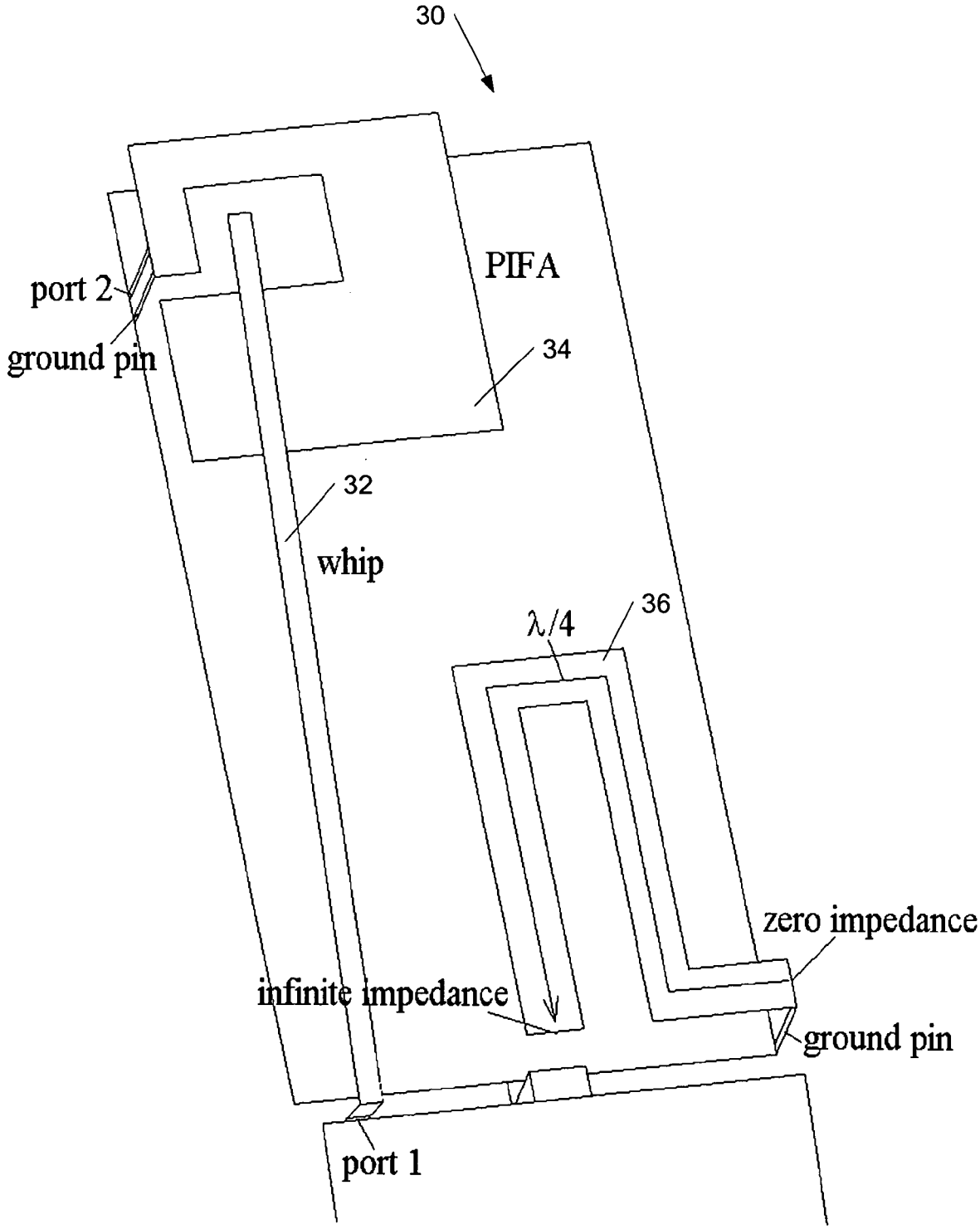
FIG. 3*a* is a schematic representation of an antenna structure wherein a separate stripline causes an impedance discontinuity between PIFA and whip antennas.
Figure 3B:
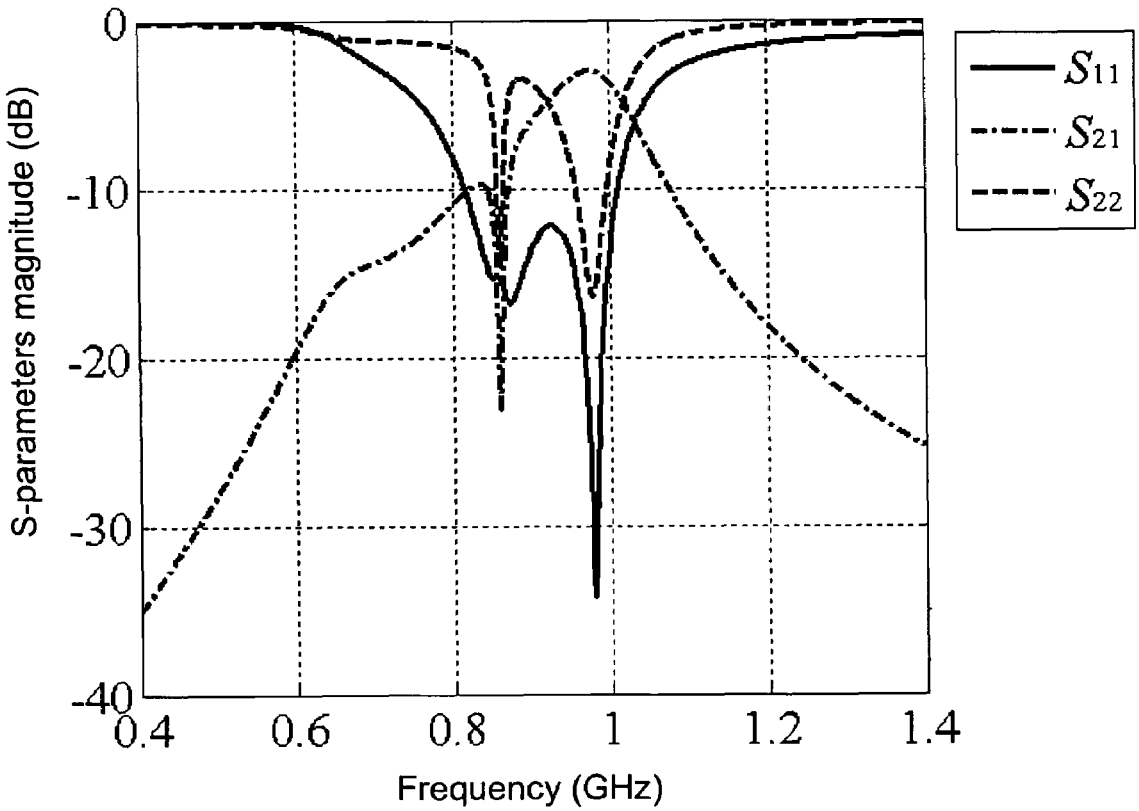
FIG. 3*b* is a graph of simulated S-parameters in a free space as a function of frequency for the structure of FIG. 3*a*, wherein an impedance discontinuity causes a local isolation maximum around 850 MHz.

FIG. 3*a* is a schematic representation of an antenna structure 30 wherein a separate stripline 36 causes the impedance discontinuity between the PIFA-type antenna 34 and the whip antenna 32. FIG. 3*b* is a graph of simulated S-parameters in a free space as a function of frequency for the structure of FIG. 3*a*, wherein the impedance discontinuity causes a local isolation maximum around 850 MHz as shown.

Figure 4A:
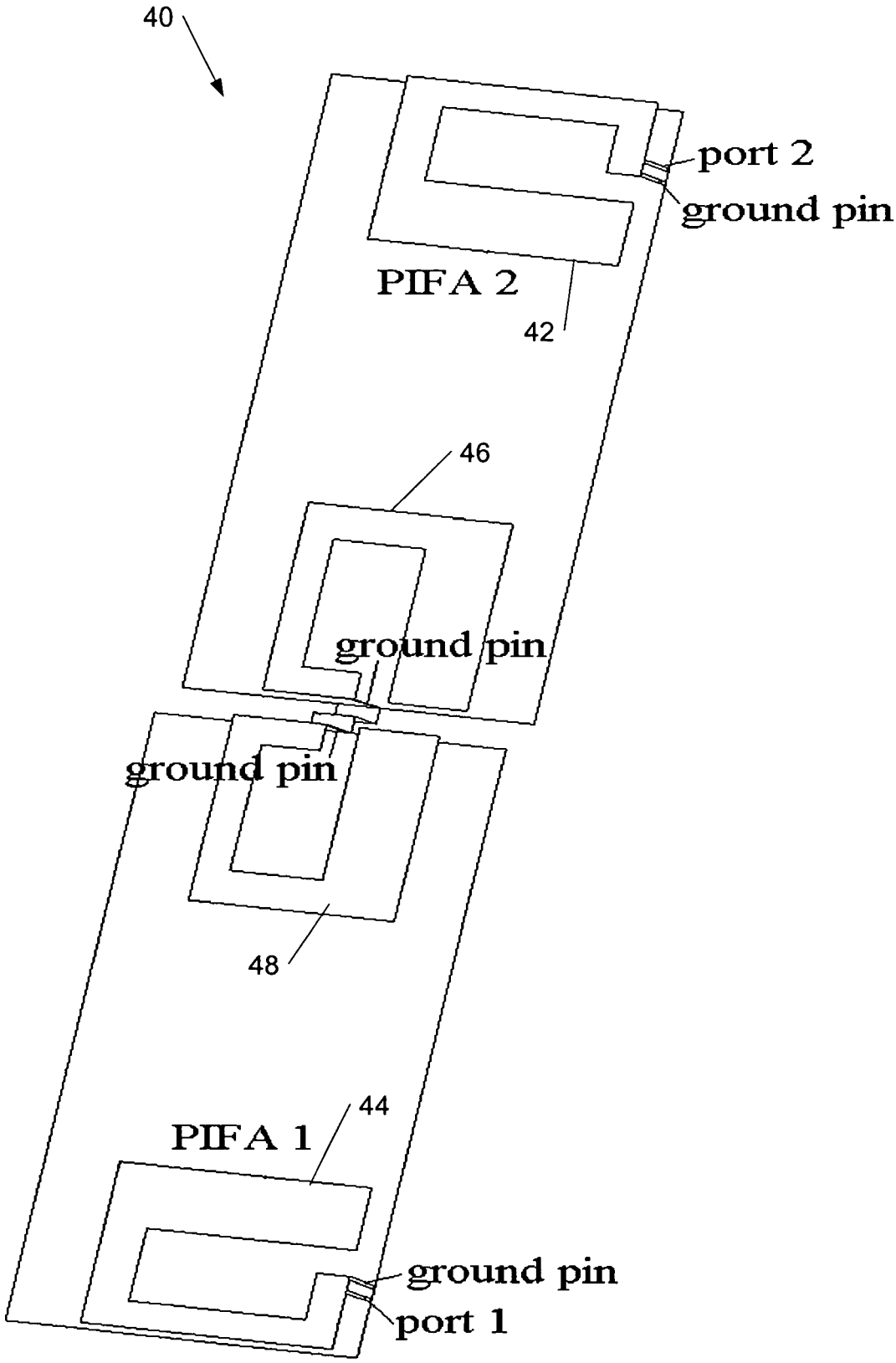
FIGS. 4*a* and 4*b* are schematic representations of an antenna structure wherein two separate striplines cause the impedance discontinuity between two PIFA-type antennas on a flip-type mobile terminal (phone)
Figure 4B:
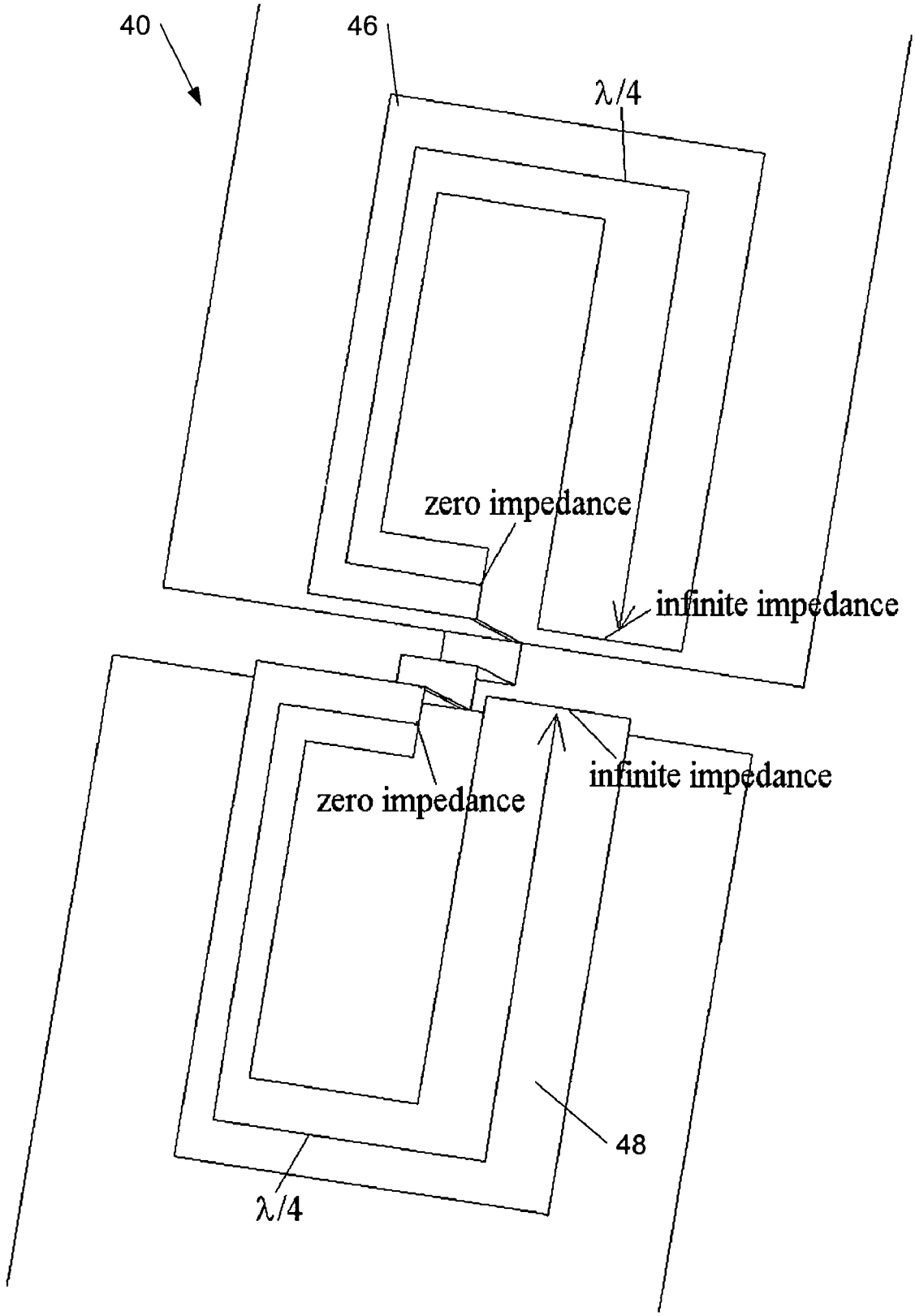

FIGS. 4*a* and 4*b* are schematic representations of antenna structure wherein two separate striplines 46 and 48 cause the impedance discontinuity between two PIFA-type antennas 42 and 44 on a flip-type mobile terminal (phone) 40. Two similar PIFA-type antennas 42 and 44 are at the opposite ends of the flip-type terminal 40 and two separate striplines 46 and 48 are in the middle causing the local isolation maximum at around 850 MHz. FIG. 4*b* shows a closer look of the middle portion of FIG. 4*a* showing two separate striplines 46 and 48.

Figure 4C:
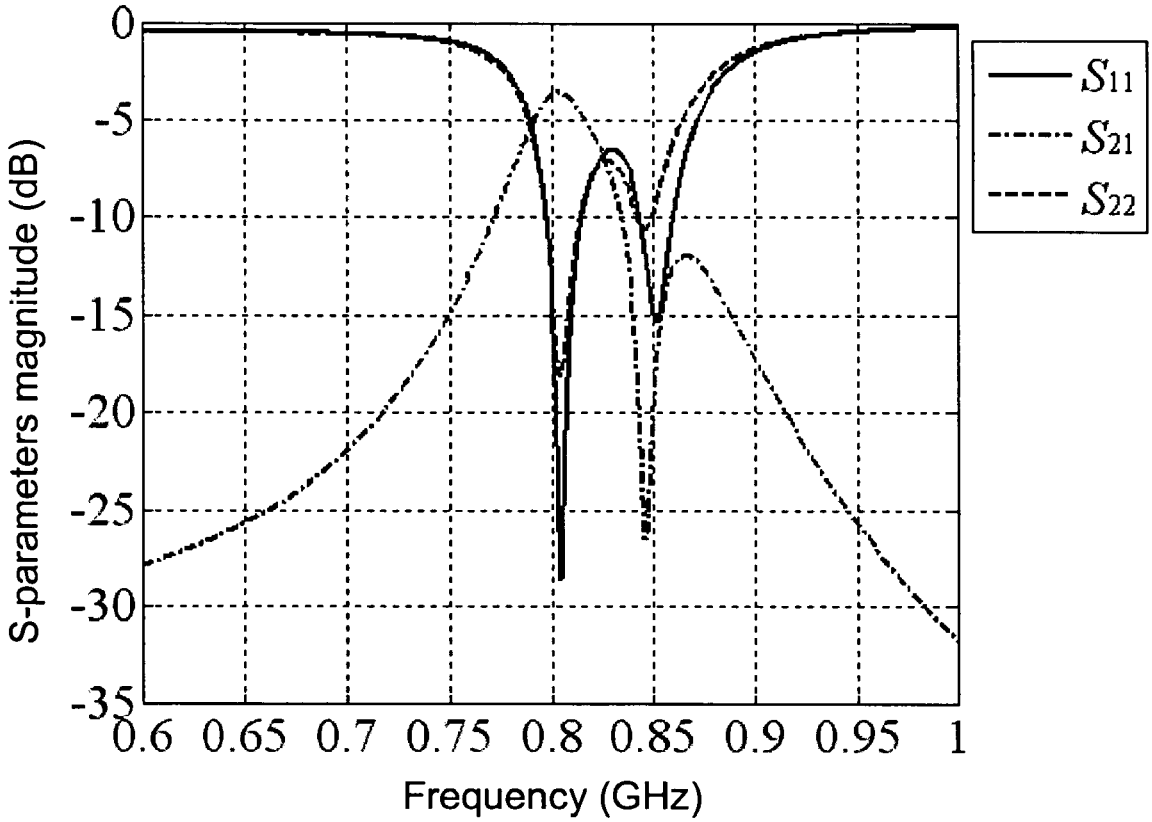
FIGS. 4*c* and 4*d* are graphs of simulated S-parameters in a free space as a function of frequency for the structure of FIG. 4*a* with striplines (FIG. 4*c*) wherein impedance discontinuity causes a local isolation maximum around 850 MHz, or without the striplines (FIG. 4*d*)
Figure 4D:
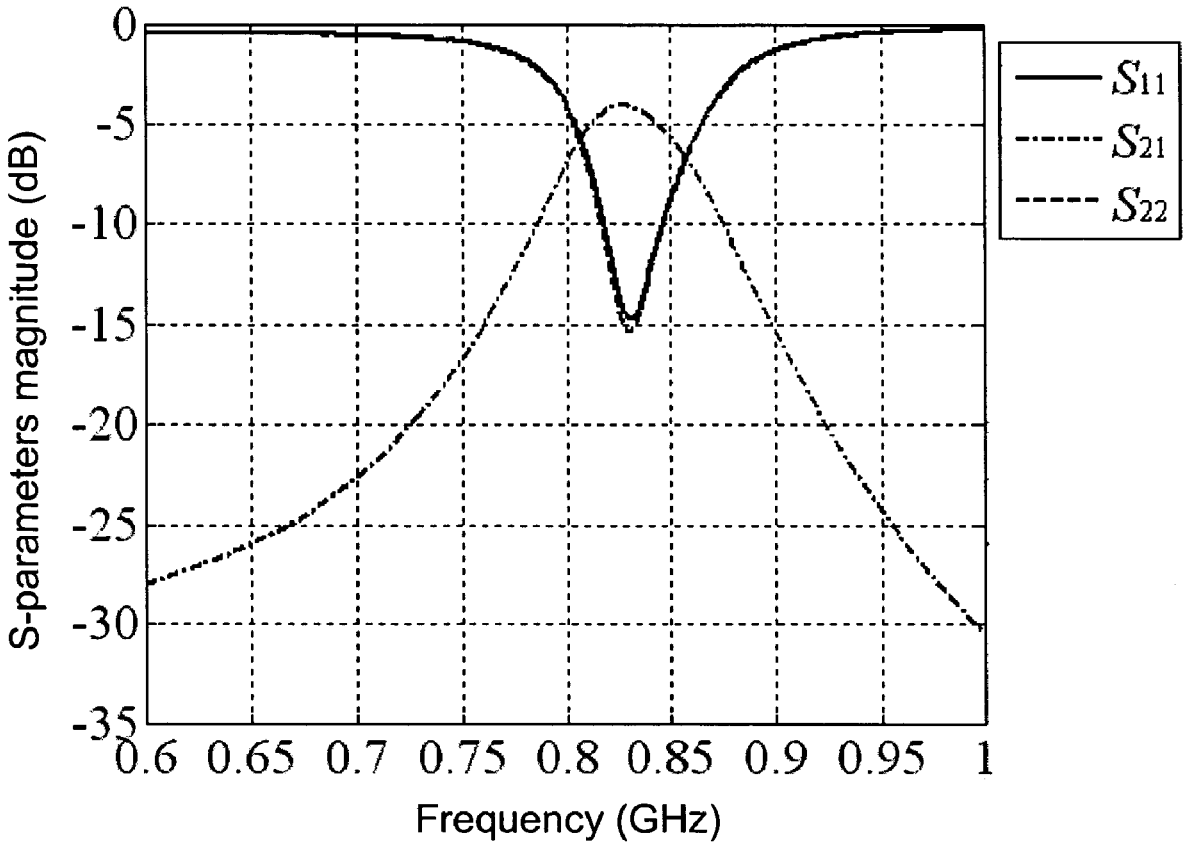

FIGS. 4*c* and 4*d* are graphs of simulated S-parameters in a free space as a function of frequency for the structure shown in FIG. 4*a* with striplines 46 and 48 (see FIG. 4*c*), wherein the impedance discontinuity causes a local isolation maximum around 850 MHz, or without the striplines 46 and 48 (see FIG. 4*d*) which is provided for comparison. It is evident from FIGS. 4*c* and 4*d* that the isolation between antennas 42 and 44 is significantly improved when the striplines 46 and 48 are used.

Moreover, according to another embodiment of the present invention, the ground for an antenna element can be constructed with an integrated ground element. The idea is to combine the antenna element and its ground into a compact part of a whole, which can be isolated from the PWB. The ground element can be implemented, e.g., with a small metallic coupler under the antenna element and two thin striplines connected to the edges of the coupler. The lengths of the two striplines can then be adjusted according to the desired operating frequency bands of the antenna. It is also possible to exploit slow-wave structures in the striplines, such as a meander-line, in order to increase their electrical lengths.

Figure 5:
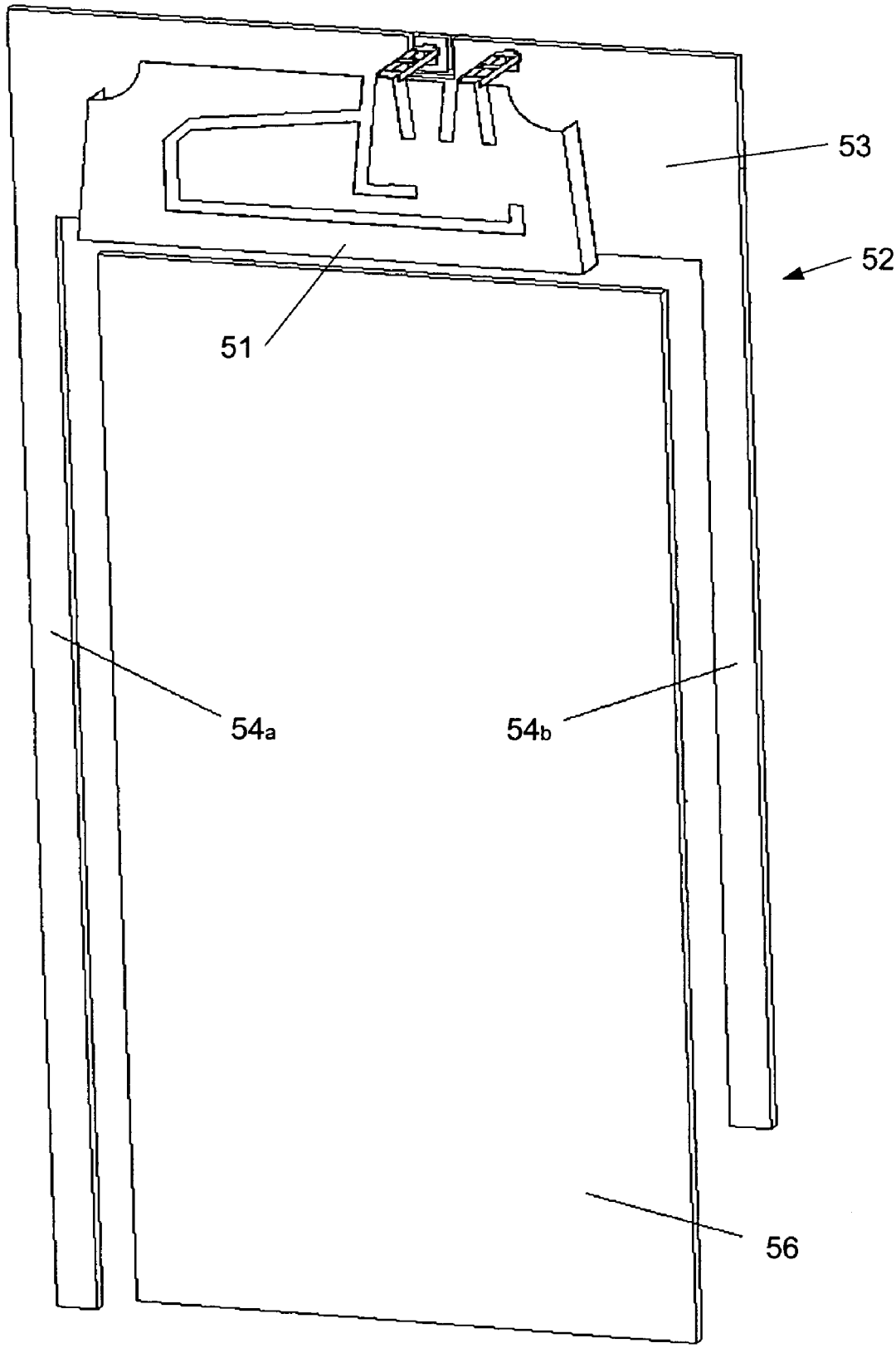
FIG. 5 is a schematic of a PIFA-type antenna placed on an integrated ground element.

In the configuration shown in FIG. 5, a typical dual-band PIFA-type mobile phone antenna 51 is placed on an integrated ground element 52. The antenna coupler 53 and the two striplines 54*a* and 54*b* of the ground element 52 are shown in FIG. 5. The metallic block 56 at the center represents the PWB of the phone. The antenna 51 is the actual antenna (PIFA) element. The integrated ground element 52 is the whole element acting as a ground for the antenna 51, and it is comprised of an antenna coupler 53 (the part under the antenna 51) and two striplines 54*a* and 54*b* (attached to the antenna coupler 53).

Figure 6A:
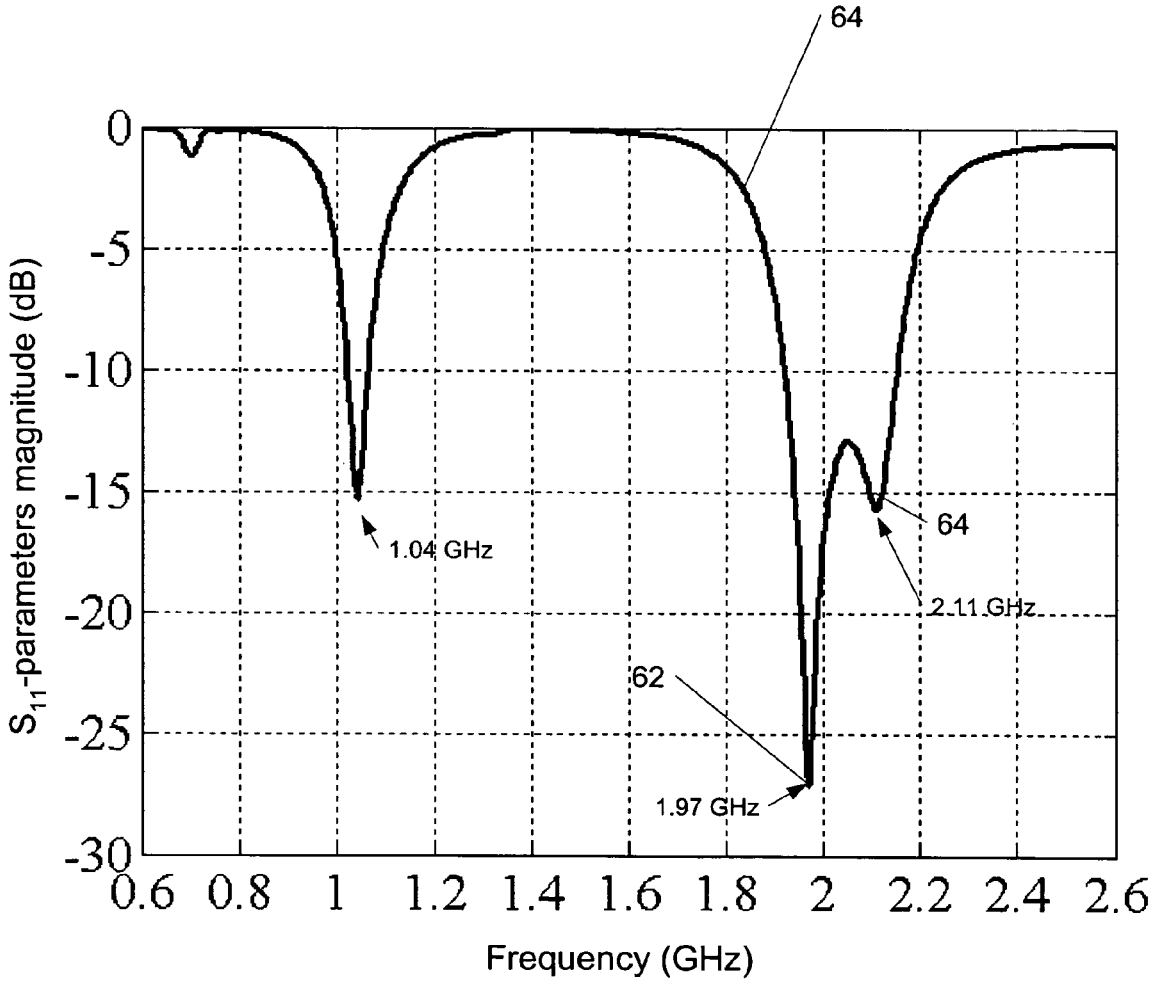
FIGS. 6*a* and 6*b* are a graph of simulated S-parameters in a free space and a Smith chart, respectively, for the structure of FIG. 5.
Figure 6B:
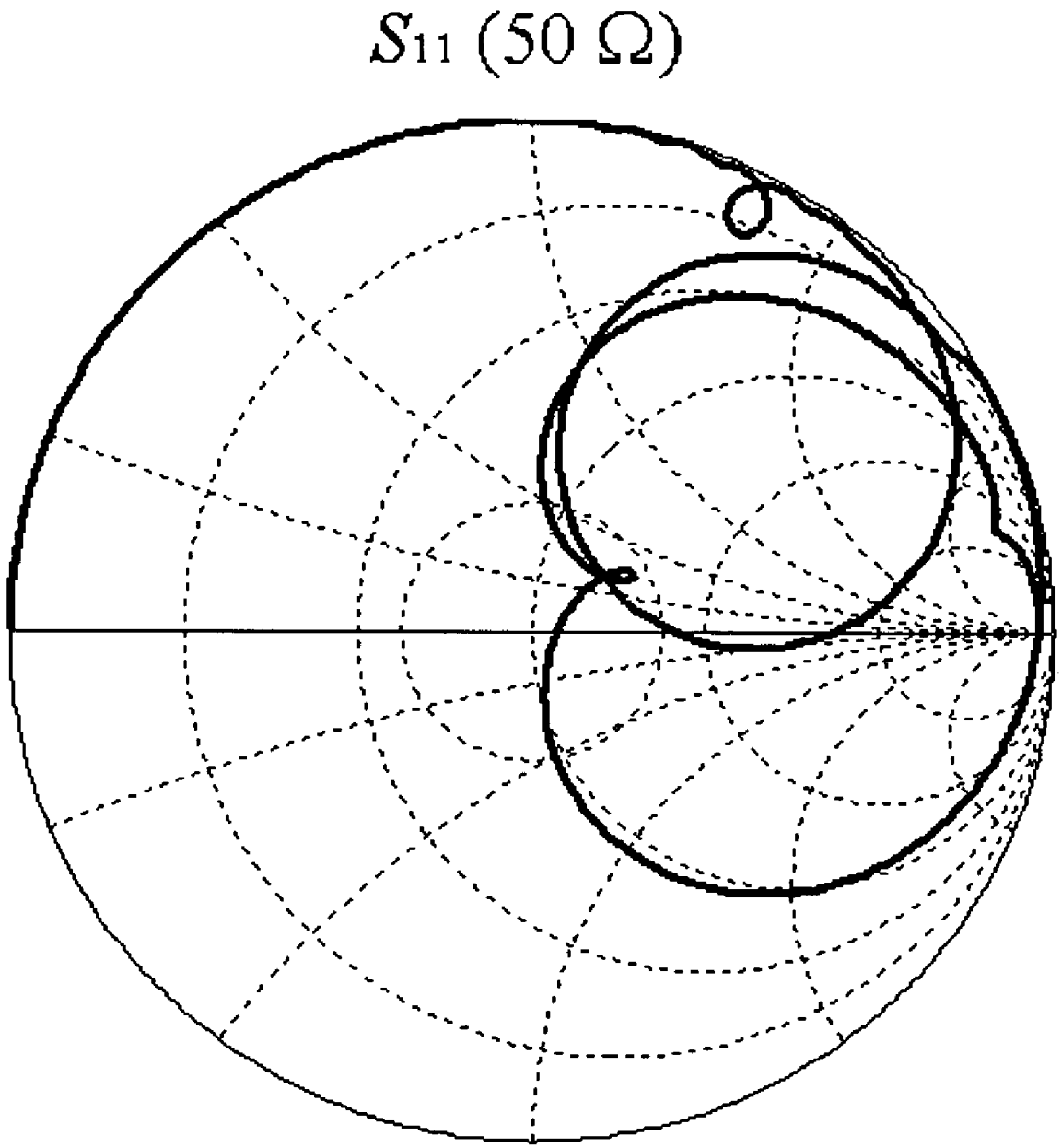

As can be seen in the simulated $S_{11}$-parameters of the antenna, shown in FIGS. 6*a* and 6*b* (Smith chart), there are two close resonances 62 and 64 at the higher frequency band thus increasing the impedance bandwidth. This is due to the slight difference in the lengths of the two ground striplines. At the lower band the two resonances are too close to be visible. The resonances represent the corresponding resonance modes of the striplines 54*a* and 54*b*.

Yet, in another embodiment of the present invention, the grounded RF microwave elements for preventing unwanted current flow (i.e., for isolating antennas) can be implemented as a balun structure in electronic communication devices. This technique is especially useful, e.g., in folded devices (e.g., a folded mobile phone), wherein the device has at least two blocks which can fold or slide relative to each other to facilitate different modes of operation. Attaching the balun structure to one of the blocks, according to an embodiment of the present invention can improve the antenna isolation performance. The performance of balun structures is well known in the art; for example, it is described in "Antennas", by J. D. Kraus and R. J. Marhefka, McGraw-Hill, 3d Edition, 2002, Chapter 23 and incorporated here by reference.

Antenna performance in fold/slide phones is not constant and dependent on the mode of operation. Performance of antenna at a frequency band of around 1 GHz is typically degraded when the phone is open compared with a close position as illustrated in FIG. 7.

Figure 7:
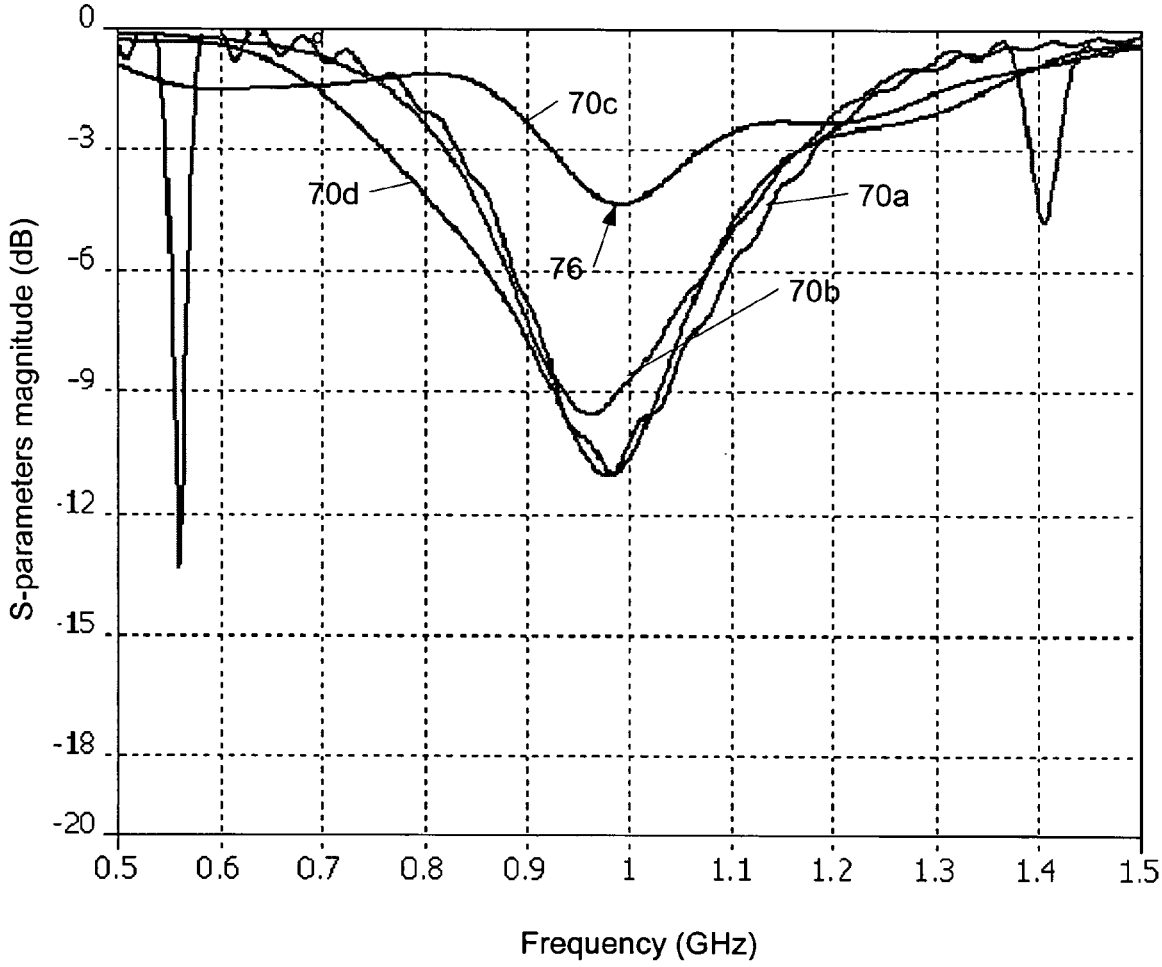
FIG. 7 is a graph of simulated S-parameters in a free space for various positions of folding blocks demonstrating antenna resonance in different positions of a folded phone shown in FIGS. 8*a* through 8*d;*
Figure 8A:
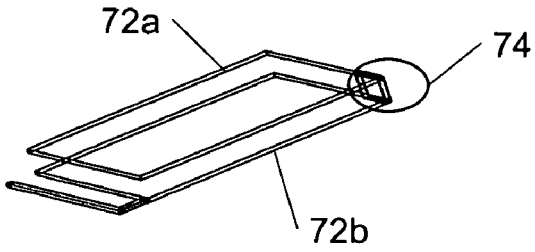
FIGS. 8*a* through 8*d* are pictures of a phone when a) the phone is closed and folding blocks are connected, b) the phone is closed and folding blocks are disconnected, c) the phone is open, and folding blocks are connected and d) the phone is open and folding blocks are disconnected.
Figure 8B:
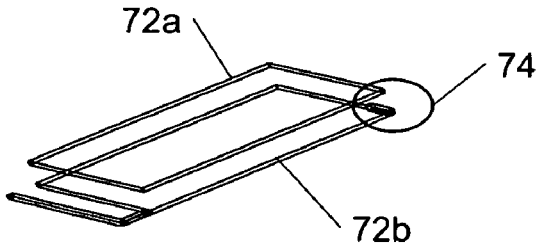
Figure 8C:
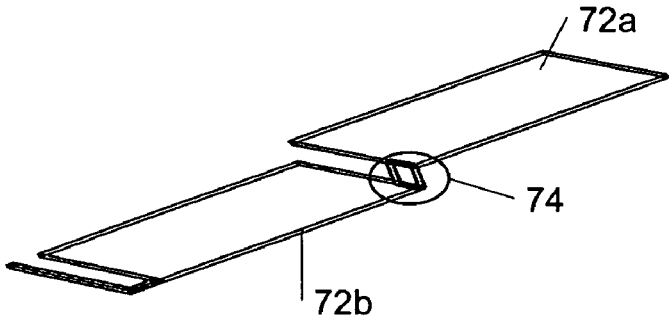
Figure 8D:
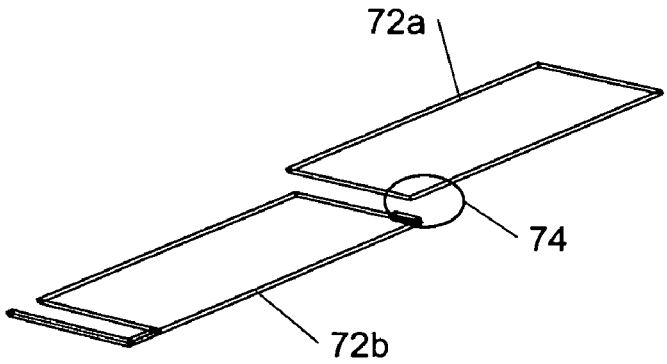

FIG. 7 is an example among others of a graph of simulated S-parameters in a free space for various positions of folding blocks demonstrating antenna resonance in different positions of a folded phone shown in FIGS. 8*a* through 8*d* below. In particular, a curve 70*a* in FIG. 7 corresponds to FIG. 8*a* wherein the phone is closed and folding blocks 72*a* and 72*b* are connected at a connection point 74. Moreover, a curve 70*b* in FIG. 7 corresponds to FIG. 8*b* wherein the phone is closed and the folding blocks 72*a* and 72*b* are disconnected at the connection point 74. Furthermore, a curve 70*c* in FIG. 7 corresponds to FIG. 8*c* wherein the phone is open and the folding blocks 72*a* and 72*b* are connected at the connection point 74. Finally, a curve 70*d* in FIG. 7 corresponds to FIG. 8*d* wherein the phone is open and the folding blocks 72*a* and 72*b* are disconnected at the connection point 74. It is seen that the worst case scenario corresponds to the curve 72*c*, wherein the phone is open and the folding blocks 72*a* and 72*b* are connected.

One of the main reasons for the problem is that some currents flow onto the upper half (e.g., the folding block 72*a*) of the phone if an antenna is located in the lower half (e.g., the folding block 72*a*). Inserting series inductors at the connection point 74 of the upper and lower halves 72*a* and 72*b* (per the prior art) requires a large area on the PWB to accommodate numbers of inductors for each line connecting the upper and lower halves 72*a* and 72*b*. Also insulating metallic hinges remains a problem.

According to an embodiment of the present invention, the isolation problem between the upper and lower halves 72*a* and 72*b* can be solved by mechanically constructing a balun in the phone in order for the current from the low half 72*b* to see the upper half 72*a* as a high impedance which prevents unwanted current flow into the upper half 72*a*. There are a number of balun concepts developed and generally available in antenna area as one of the matching methods. Some examples are illustrated in FIG. 23- 2 on page 804 in "Antennas", by J. D. Kraus and R. J. Marhefka, McGraw-Hill, 3d Edition, 2002, Chapter 23, quoted above. Type I balun or "bazooka" was taken as an example and simulation was carried out to verify the effect if it can be used for preventing/reducing parasitic currents on the PWB.

Figure 9:
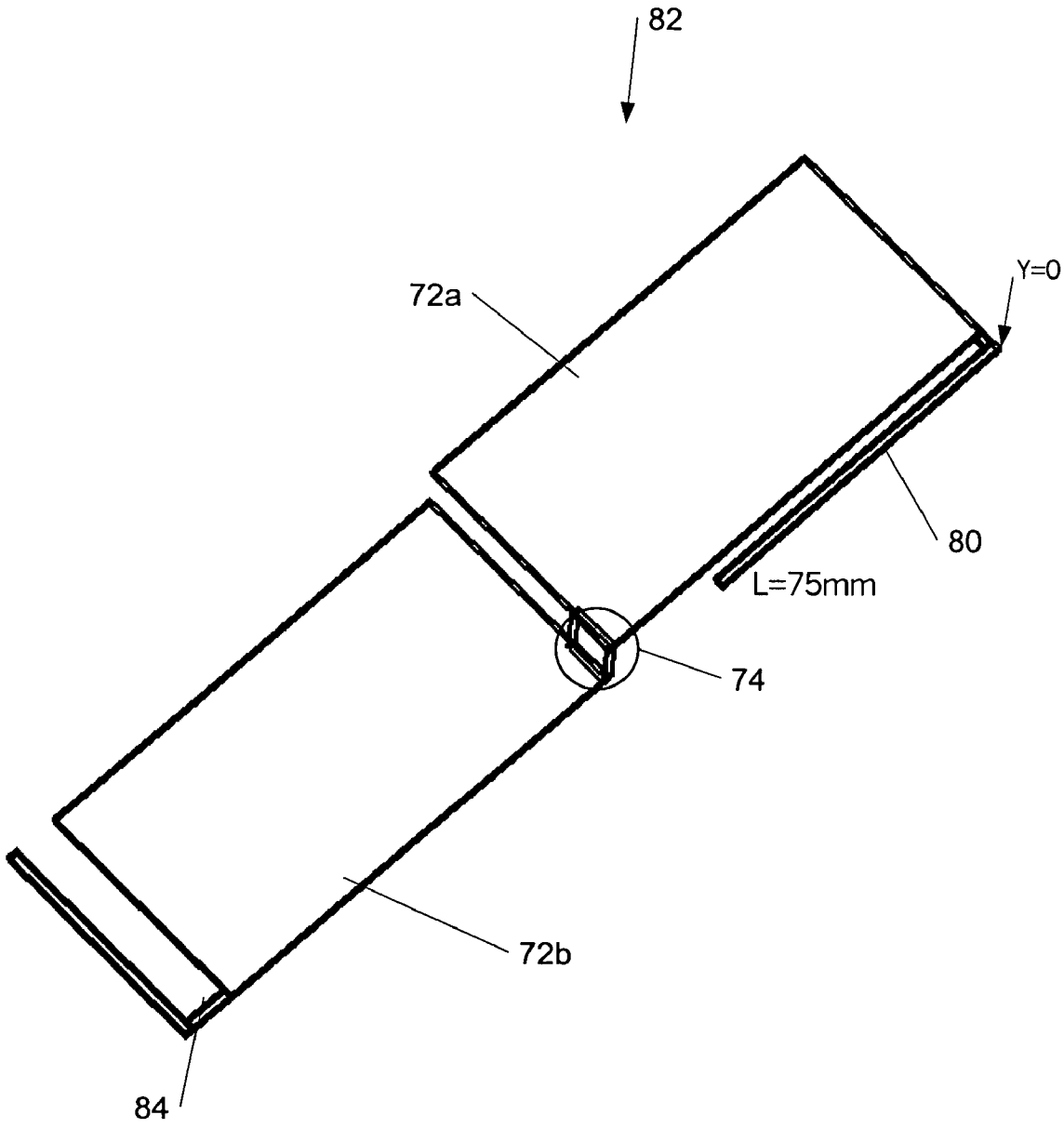
FIG. 9 is a picture of a folded phone in an open position with a balun structure (basuka) attached.

FIG. 9 shows one example among others of a picture of a folded phone 82 in an open position with an antenna 84 in the low half 72*b* and a balun structure (basuka) 80 attached to the upper half 72*a*. According to an embodiment of the present invention, the essence of the balun structure design is to have a conduction material (e.g. a rod) 80 along the side of upper half 72*a* with the length of approximately quarter wavelength of interest (e.g., an operational frequency of the phone), i.e., about 75 mm for the operating frequency of 1 GHz. A top end of this rod 80 is connected to the upper half 72*a* of the phone 82 while a bottom end of the rod 80 is left open.

Figure 10:
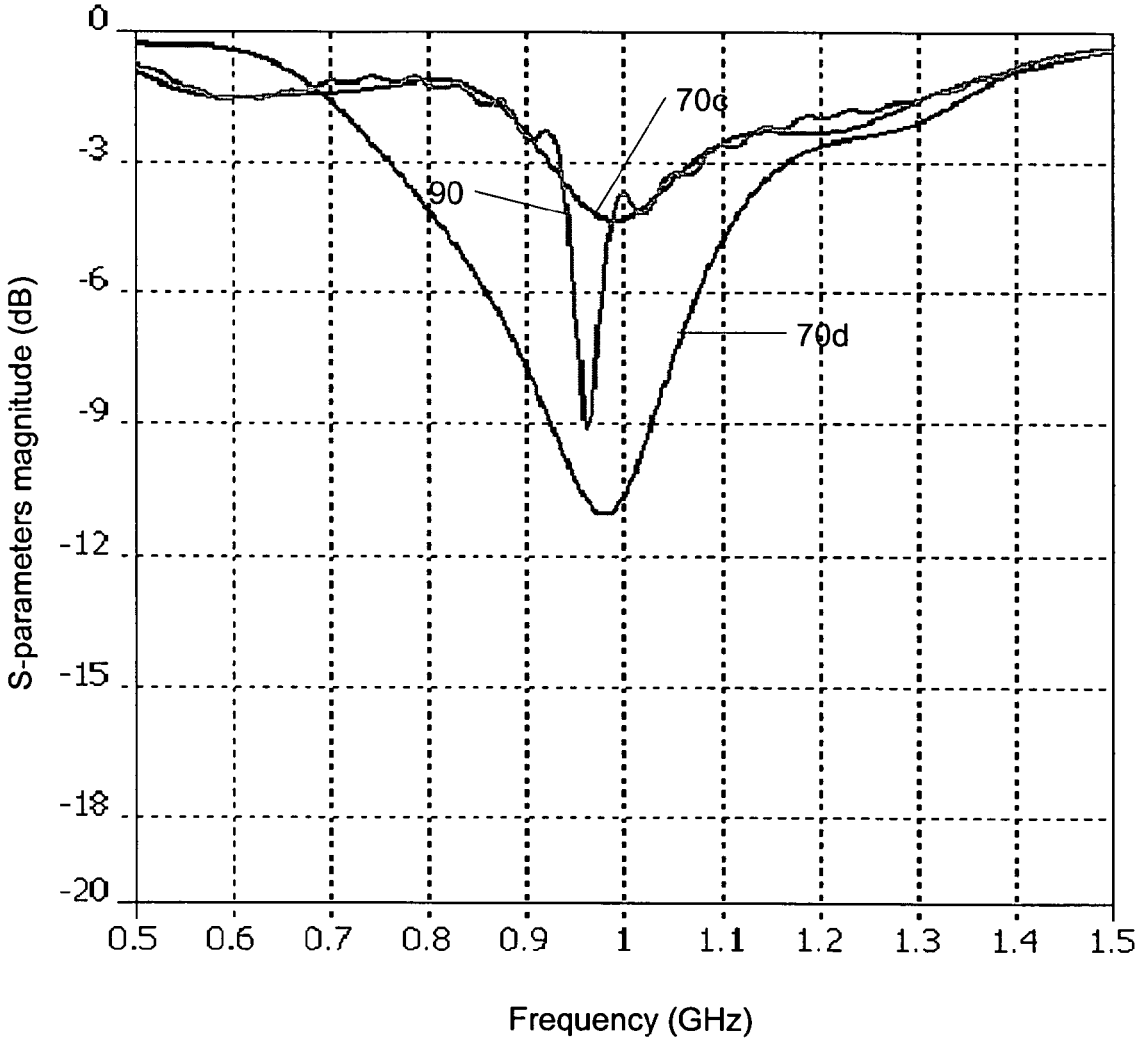
FIG. 10 is a graph of simulated S-parameters in a free space demonstrating performance improvement of a folding phone with a balun structure ("bazooka") attached.

FIG. 10 is a graph of simulated S-parameters in a free space demonstrating a performance improvement of the folding phone 82 of FIG. 9 with the balun structure ("bazooka") 80 attached. Curves 70*c* and 70*d* form FIG. 7 are shown for comparison. A curve 90 in FIG. 10 corresponds to a worst case scenario for the phone 82 of FIG. 9 with the balun element (rod) 80, wherein the phone 82 is open and folding blocks 72*a* and 72*b* are connected at a connection point 74.

Comparing to the worst case scenario for the curve 70*c* wherein the phone is open and the folding blocks 72*a* and 72*b* are connected, the improvement in return loss for the curve 90 is clearly observed at around 0.97 GHz. Moreover, the curve 90 at around 0.97 GHz almost approaches the target performance indicated by the curve 70*d* wherein the phone is open and the folding blocks 72*a* and 72*b* are disconnected.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. An electronic communication device comprising:

at least one antenna; and an RF microwave element electrically connected to a ground plane of said at least one antenna optimized for improving an isolation from electro-magnetically coupled currents between said at least one antenna and other RF components of said electronic communication device in said ground plane, wherein at least a surface of a portion of said RF microwave element is not located on or intersects a surface of a main ground plane which is a part of a printed wiring board of said electronic communication device, and wherein said ground plane of said at least one antenna is: said main ground plane, or electrically isolated from said printed wiring board comprising said main ground plane.

2. The electronic communication device of claim 1, wherein said electronic communication device is for wireless communications.

3. The electronic communication device of claim 1, wherein said other RF components include at least one further antenna.

4. The electronic communication device of claim 3, wherein said at least one further antenna is a whip-type antenna.

5. The electronic communication device of claim 1, wherein said at least one antenna is a planar inverted-F antenna.

6. The electronic communication device of claim 1, wherein said RF microwave element is a short-circuited section of a quarter-wavelength long transmission line.

7. The electronic communication device of claim 6, wherein said quarter-wavelength long transmission line is a stripline.

8. The electronic communication device of claim 1, wherein said RF microwave element contains a metallic coupler and two striplines, and said ground plane of said antenna is electrically isolated from said printed wiring board comprising said main ground plane.

9. The electronic communication device of claim 8, wherein said two striplines have different lengths.

10. The electronic communication device of claim 1, wherein said electronic communication device comprises at least two blocks which are configured to fold or slide relative to each other to facilitate different modes of operation of said electronic communication device.

11. The electronic communication device of claim 10, wherein said RF microwave element is a balun structure attached to at least one of said at least two blocks.

12. The electronic communication device of claim 11, wherein said balun structure is a rod made of a conducting material and parallel to said at least one of said at least two blocks and attached to said at least one of said at least two blocks at one end of said rod, wherein another end of said rod is left open and said rod has a length of substantially a quarter wavelength which said electronic communication device operates on.

13. The electronic communication device of claim 1, wherein said RF microwave element comprises a resonator-type component configured for increasing at least one isolation maximum of said isolation from electromagnetically coupled currents at a predetermined frequency band.

14. A method, comprising:

placing an RF microwave element electrically connected to a ground plane of at least one antenna optimized for improving an isolation from electro-magnetically coupled currents in a ground plane between said at least one antenna and other RF elements in an electronic communication device in said ground plane, wherein at least a surface of a portion of said RF microwave element is not located on or intersects a surface of a main ground plane which is a part of a printed wiring board of said electronic communication device, and wherein said ground plane of said at least one antenna is: said main ground plane, or electrically isolated from said printed wiring board comprising said main ground plane.

15. The method of claim 14 wherein said electronic communication device is for wireless communications.

16. The method of claim 14, wherein said other RF elements include at least one further antenna.

17. The method of claim 16, wherein said at least one further antenna is a whip-type antenna.

18. The method of claim 14, wherein said at least one antenna is a planar inverted-F antenna.

19. The method of claim 14, wherein said RF microwave element is a short-circuited section of a quarter-wavelength long transmission line.

20. The method of claim 19, wherein said quarter-wavelength long transmission line is a stripline.

21. The method of claim 14, wherein said RF microwave element contains a metallic coupler and two striplines.

22. The method of claim 21, wherein said two striplines have different lengths, and said ground plane of said antenna is electrically isolated from said printed wiring board comprising said main ground plane.

23. The method of claim 14, wherein said electronic communication device comprises at least two blocks which are configured to fold or slide relative to each other to facilitate different modes of operation of said electronic communication device.

24. The method of claim 23, wherein said RF microwave element is a balun structure attached to at least one of said at least two blocks.

25. The method of claim 24, wherein said balun structure is a rod made of a conducting material and parallel to said at least one of said at least two blocks and attached to said at least one of said at least two blocks at one end of said rod, wherein another end of said rod is left open and said rod has a length of substantially a quarter wavelength which said electronic communication device operates on.

26. An electronic communication device comprising:

receiving/transmitting means; and

RF means, electrically connected to a ground plane of said receiving/transmitting means and optimized for improving an isolation from electro-magnetically coupled currents between said receiving/transmitting means and other RF components of said electronic communication device in said ground plane, wherein at least a surface of a portion of said RF means is not located on or intersects a surface of a main ground plane which is a part of a printed wiring board of said electronic communication device, and wherein said ground plane of said receiving/transmitting means is: said main ground plane, or electrically isolated from said printed wiring board comprising said main ground plane.

27. The electronic communication device of claim 26, wherein said receiving/transmitting means is at least one antenna, and said RF means is an RF microwave element.

* * * * *